United States Patent [19]

Siskin et al.

[11] Patent Number: 4,491,514

[45] Date of Patent: Jan. 1, 1985

[54] PROCESS FOR BENEFICIATING OIL-SHALE

[75] Inventors: Michael Siskin, Livingston; Glen B. Brons, Phillipsburg, both of N.J.

[73] Assignee: Exxon Research & Engineering Co., Florham Park, N.J.

[21] Appl. No.: 600,432

[22] Filed: Apr. 16, 1984

[51] Int. Cl.[3] ..... C10G 1/04

[52] U.S. Cl. ..... 208/11 LE; 423/114; 423/131; 423/157; 423/658.5

[58] Field of Search ..... 208/8 LE, 11 LE, 11 R; 423/114, 119, 131, 130, 157, 658.5

[56] References Cited

U.S. PATENT DOCUMENTS

| | | | |
|---|---|---|---|
| 3,503,705 | 3/1970 | Tackett | 423/119 |
| 3,516,787 | 6/1970 | Van Nordstrand | 423/119 |
| 3,642,433 | 2/1972 | Dyni | 423/119 |
| 3,721,730 | 3/1973 | Haas | 423/119 |
| 3,821,353 | 6/1974 | Weichman | 423/119 |
| 3,859,413 | 1/1975 | Haas | 423/119 |
| 3,962,403 | 6/1976 | Wyslouzil | 423/206 R |
| 4,176,042 | 11/1979 | Fahlström | 423/658.5 |
| 4,250,016 | 2/1981 | Estes et al. | 208/11 LE |
| 4,342,729 | 8/1982 | Garcia Clavel et al. | 423/131 |
| 4,408,999 | 10/1983 | Nadkarni et al. | 208/11 LE |

*Primary Examiner*—Delbert E. Gantz
*Assistant Examiner*—A. Pal
*Attorney, Agent, or Firm*—Henry E. Naylor

[57] ABSTRACT

Disclosed is a process for removing mineral matter from oil-shale which method comprises contacting the oil-shale with (a) an ammonium salt solution, and (b) a nonionic surfactant at a temperature from about 0° C. to about 300° C. for a time which is sufficient to substantially separate at least about 80 wt. % of the carbonate mineral matter of the oil-shale.

7 Claims, No Drawings

PROCESS FOR BENEFICIATING OIL-SHALE

BACKGROUND OF THE INVENTION

The present invention relates to the beneficiation of oil-shale by treating the oil-shale with a solution of an ammonium salt and a nonionic surfactant at a temperature from about 0° C. to about 300° C. for a time sufficient to remove minerals from the oil-shale.

Oil-shale, a sedimentary rock found in vast formation in several parts of the world, contains about 5 to about 60 wt.% organic material. About 10% of this organic material is extractable with tetrahydrofuran and is called bitumen. The remainder of the organic material is insoluble in organic and inorganic solvents and is called kerogen. The remainder of the oil-shale is inorganic and is composed of various minerals and clays. Much work has recently been done to develop efficient methods for acquiring useful liquids and gases from oil-shale as replacements for petroleum liquids. The inherent mineral matter in oil-shale represents significant debits in both the handling and processing of the resource. Typically, the organic material which can be converted to useful fuel and chemical feedstock. Preferably liquids represents only about 15–30 wt.% of the oil-shale. Furthermore, during processing there is considerable increased abrasive wear on preparation and conversion plants owing to the nature of mineral matter. Also, relatively larger reactor sizes are required to accomodate the higher material throughputs necessitated by the large quantities of mineral matter. Most important, large quantities of rock needs to be heated to high temperatures in order to break-down the kerogen of the oil-shale to liquid and gaseous products. This represents a loss in energy efficiency since most of this heat is not recoverable as useful work. In processes which include a catalyst during processing, there is a significant potential that the minerals inherently present in the oil-shale will contribute to catalyst poisoning. Consequently, various processes have been devised over the years to beneficiate, or demineralize oil-shale prior to further processing to concentrate the organic material and to alleviate the above mentioned problems associated with oil-shale processing.

Although both physical and chemical methods have been developed for separating organic material from oil-shale, thereby leaving substantially all of the mineral matter behind, chemical methods usually are superior over physical methods because of better separations obtained. One common type of chemical method for the separation of kerogen from oil-shale is the acid extraction technique. Such technique typically involves the digestion of oil-shale with hydrochloric aid, hydrofluoric acid, or both. The hydrochloric acid dissolves the carbonate minerals and the hydrofluoric acid dissolves the silicate and clay minerals, thereby leaving a kerogen material containing about 5 to 10 wt.% minerals. Although such schemes have met with varying degrees of success, they suffer the disadvantage of being corrosive and, in most cases the inability to regenerate the acid reactants economically for recycle makes the process unattractive.

A variation in this acid technique is disclosed by R. D. Thomas in Fuel, 48, 75–80 (1969) where all of the mineral carbonates are removed from Green River oil-shale by treatment with carbonic acid. Thomas claims that after sodium hydroxide washing to remove fine clay-like particles, the carbonate-free material can be centrifuged in a saturated aqueous calcium chloride solution to yield a concentrate containing 85–90 wt.% of the original kerogen with an ash content of less than 30 wt.%. Attempts to reproduce the physical separation results after demineralization with carbonic acid have been unsuccessful. See Vandergrift, G. F., Winans, R. E., and Horowitz, E. P., Fuel, 59, 634–6 (1980).

A variation of using acids to enrich the kerogen content of oil-shales which are rich in carbonates involves leaching by use of a sulfuric acid medium generated by the oxidizing capabilities of specific bacteria which convert pyrite in the oil-shale to sulfuric acid. The sulfuric acid produced decomposes the carbonate minerals in the oil-shale leaving a kerogen enriched material containing significant amounts of silica. See U.S. Pat. No. 4,043,884.

Other approaches to chemical beneficiation include extraction of low grade Western U.S. oil-shales with aliphatic amides to recover 69 wt.% to 83 wt.% of the organics (U.S. Pat. No. 4,357,230), and treatment of various oil-shales with a 1:1 mixture of trichloroisocyanuric acid and a chlorine donor such as calcium hypochlorite in the presence of a petroleum based naphtha solvent giving recoveries of organics up to about 98 wt.% (U.K. Pat. No. 2,090,858).

Furthermore, disclosed in Intl. Patent Appl. No. Wo 82/03404 is a two-step treatment of oil-shale with 16 parts of fused alkali metal caustic at 350° C. for 40 minutes followed by a sulfuric acid wash which led to recovery of 86 wt.% of the organics. This type of treatment suffers from the disadvantage that it may have a detrimental effect on the kerogen structure and reactivity.

Although various methods have been used, including physical grinding combined with chemical, for beneficiating oil-shale, such prior art methods have not been able to effect a significant separation of mineral matter from the organic material under relatively mild conditions without the reactant being simultaneously and irreversibly destroyed. Consequently, there is still a need in the art for processes which are able to beneficiate oil-shale under relatively mild conditions and leave the beneficiation reagent in a form which is easily regenerable. Furthermore, none of the prior art methods suggest the use of ammonium salts for beneficiating oil-shales.

SUMMARY OF THE INVENTION

In accordance with the present invention there is disclosed a process for removing mineral matter from oil-shale which process comprises contacting the oil-shale with (a) an ammonium salt solution, and (b) a nonionic surfactant, at a temperature from about 0° C. to about 300° C. for a time sufficient to remove at least about 80 wt.% of the carbonate mineral matter from the oil-shale and to obtain a separation of the organic rich and mineral rich material.

In preferred embodiments of the present invention the oil-shale is contacted at a temperature from about 60° C. to about 250° C. and the ammonium salt is selected from the group consisting of ammonium carbonate, ammonium bicarbonate, ammonium acetate ammonium nitrate, ammonium phosphates, and ammonium sulfate.

DETAILED DESCRIPTION OF THE INVENTION

The general composition and characteristics of oil-shale are well known (See "Kerogen" edited by B. Durand, Editors Technip, Paris 1980) and will therefore not be described in detail herein. For practical purposes, the oil-shale should contain at least about 5, preferably at least about 10, and more preferably at least about 20% by weight of organic material, based on the total weight of the oil-shale. Such oil-shales usually contain at least about 7.5, preferably at least about 15, and more preferably between about 25 and 75 gallons of oil per ton of oil-shale, by Fischer Assay.

Although the present invention can be practiced on any type of oil-shale, it is more advantageous to employ an oil shale having a high carbonate mineral matter composition.

Although the particle size of the oil-shale is not critical, it is preferred for convenience of handling that the oil-shale be crushed to a particle size having an average diameter of less than about 1 inch, preferably less than about ½ inch. The diameter of the particles as referred to herein is the smallest size of the screen opening through which particles of the designated "diameter" will pass.

Ammonium salts suitable for use in the instant invention are ammonium salts of organic and inorganic acids. Preferred are the ammonium salts of strong mineral acids. Nonlimiting examples of such ammonium salts suitable for use herein include ammonium carbonate, ammonium bicarbonate, ammonium acetate, ammonium nitrate, ammonium sulfate and ammonium phosphates. Preferred are ammonium nitrate and ammonium sulfate, more preferred is ammonium sulfate.

Surfactants which can be used in the practice of the present invention include any nonionic surfactants suitable for such use. Non-limiting examples of such nonionic surfactants include ethoxylated derivatives of phenols, amines, carboxylic acids, alcohols and mercaptans, as well as polyhydroxy compounds. The ethoylated phenols may have the formula:

$$(R)_rA[OCH_2CH_2O)_p]_qH$$

wherein R is $C_1$ to $C_{24}$ alkyl, A is benzene, naphthalene or diphenyl, p is 2 to 60, q is 1 or 2 and r is 1 to 5 with the proviso that when r is 1, $R^6$ is at least a $C_8$ alkyl. Preferred nonionic surfactants include ethoxylated $C_8$-$C_{24}$ alkylphenols, ethoxylated octyl, nonyl or dodecyl phenols containing 8 to 24 —$CH_2CH_2O$—groups, or ethoxylated dinonyl phenols containing 8 to 50 —$CH_2CH_2O$—groups.

Ethoxylated amines may be cationic or nonionic depending on the degree of ethoxylation. Higher degrees of ethoxylation render fatty amines nonionic in character. Preferred amines are $C_8$ to $C_{30}$ alkyl amines. $C_8$ to $C_{30}$ ethoxylated amines or quaternary ammonium salts thereof. Ethoxylated amines of the formula

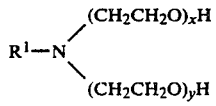

where $R^1$ is a $C_8$ to $C_{30}$ aliphatic radical and the sum of x+y is from 2 to 30.

Aliphatic carboxylic acids of from 8 to 30 carbon atoms can be esterified with ethylene oxide to form nonionic surfactants. The degree of ethoxylation may be from 2 to 30. Also, $C_8$ to $C_{25}$ alkanols and mercaptans can be converted to polyethoxy ethers and thio-ethers by reaction with ethylene oxide.

Examples of nonionic surfactants which are not polyethoxylated are esters of sugar alcohols, sorbitol and mannitol. The acid moiety of the ester is generally a fatty acid. Other fatty acid derivatives include esters of di- and poly saccharides and condensates of fatty acids with alkanolamines.

The amount of surfactant employed herein is at least about 0.5 wt.%, preferably at least about 1 wt.%, based on the weight of the ammonium salt solution.

The temperatures at which the instant process is carried out will generally be at temperatures from about 0° C. to about 100° C. when atmospheric pressure is employed. If higher pressures are employed the temperature can be as high as approximately 300° C. Preferred is a temperature from about 60° C. to about 250° C. If salts such as ammonium carbonate and bicarbonate are used, which decompose at temperatures greater than about 50° C. the elevated pressure must be used to keep components of the salts in solution and care must be taken to maintain a low partial pressure of $CO_2$ in order to facilitate the decomposition reaction of carbonate minerals.

In the practice of the present invention the oil-shale is contacted with the ammonium salt solution and nonionic surfactant for an effective amount of time in an appropriate reactor at an effective temperature; that is, for a time sufficient to remove a predetermined amount of carbonate minerals from the oil-shale. It will be appreciated that the specific amount of time and specific temperature will be dependent on such things as temperature, specific ammonium salt, concentration of the salt, pressure, and size of the oil-shale employed. By way of example, a one molar aqueous solution of ammonium sulfate will remove at least about 80 wt.% of the carbonate mineral matter from 80–100 mesh particles of Green River oil-shale which contains 20.6 wt.% organic material and about 40 wt.% carbonate minerals when the oil-shale is contacted with a 1M ammonium sulfate solution for 2 days at a temperature of 100° C.

After the desired amount of mineral matter has been removed from the oil-shale, the result is a two phase system. That is, there will be an upper aqueous phase and a lower phase. Carbon dioxide and ammonia gas which evolves during the decomposition of minerals can be recovered and used in the regeneration of the ammonium salt. The lower phase is characterized as having two or more layers, an upper mineral rich layer and a lower organic rich layer. The lower organic rich layer can be separated from the aqueous phase and the mineral rich layer by any appropriate separation technique. One technique would be to draw off the aqueous phase followed by syphoning off the mineral rich phase, thereby leaving the organic rich phase (beneficiated oil-shale) which can be passed along for further processing.

The ammonium salt solution should be present in at least a stoichiometric amount based on the amount of carbonate minerals present in the starting oil-shale. Generally, a 1 to 4 molar solution of the ammonium salt is adequate.

The following examples serve to more fully describe the manner of practicing the above-described invention as well as to set forth the best modes contemplated for carrying out various aspects of the invention. It is to be understood that these examples in no way serve to limit the true scope of this invention, but rather, are presented for illustrative purposes.

EXAMPLE 1. (Comparative)

Green River oil-shale (3 g) containing 20.6 wt% organic material and 40 wt.% carbonate minerals and having an 80–100 mesh particle size was charged into a reactor containing a magnetic stir bar. A 1M ammonium sulfate solution (30 mL) was then charged into the reactor and the mixture was heated to 100° C. with stirring for 48 hours under a nitrogen atmosphere. The reaction mixture was then cooled to room temperature and filtered through a Teflon filter paper lined Buchner funnel. The resulting beneficiated oil-shale was then dried in a vacuum oven at 100° C. overnight and analyzed for weight loss. The weight loss represents the amount of carbonate minerals removed from the oil-shale. It was found that the solids phase weighed about 40% less then the starting oil-shale sample. This indicated that the oil-shale sample lost about 40 wt.% of its mineral matter thus leaving a beneficiated product having about 35 wt.% organic material, based on the total weight of the material.

EXAMPLE 2 (Comparative)

A sample of Green River (3 g) oil-shale having the same organic and carbonate minerals as that used in the previous examples was charged in a reactor with a 1M aqueous ammonium sulfate solution (30 mL) and 4 wt.% of the monoethanolamine salt of $C_{12}$ benzenesulfonic acid (an anionic surfactant). The 4 wt.% was based on the weight of the ammonium salt solution. The reaction mixture was maintained with stirring at a temperature of 80° C. for 72 hours after which it was cooled to room temperature (about 20° C.). The result was an upper aqueous phase and a lower phase which appeared to be solids. The lower phase also appeared to be composed of two distinct layers based on color, an upper tan layer and a lower dark brown layer. At first it was thought that the upper layer was a mineral rich layer and the lower layer an organic or kerogen rich layer. After analysis, the upper layer was found to be comprised of 27.9 wt.% organic material and the lower layer was found to be comprised of 27.7 wt.% organic material, both weight percents based on the total weight of the sample from the particular layer. Consequently, what appeared at first to be two chemically distinct layers turned out to be two layers of two different colors but having substantially the same composition.

This example demonstrates that an anionic surfactant is unsuitable for separating the mineral matter from the organics in the so-called solids phase resulting from the treatment of oil-shale with an ammonium salt solution.

EXAMPLE 3 (Comparative)

The procedure of Comparative Example 2 above was followed except the cationic surfactant ethoquad $C_{12}$, methyl bis (2-hydroxyethyl)-cocoammonium chloride, was used in place of the anionic surfactant.

The resulting solids phase showed a weight loss of 34.9% which indicated that substantial demineralization of the oil-shale had occurred.

The results was the same as in Comparative Example 2 above except the upper tan layer was found to be comprised of 35.8 wt.% organic material and the bottom layer 34.7 wt.% organic material. Thus, cationic surfactants are no better than anionic surfactants for separating organic material from mineral matter of the resulting lower phase produced upon the treatment of oil-shale with an ammonium salt solution.

EXAMPLE 4

The procedure of Comparative Example 2 above was followed except that the nonionic surfactant Igepal CO 730, an ethoxylated nonyl phenol containing 15 moles of ethylene oxide, was used in place of the anionic surfactant.

The result was similar to the above two examples in that an upper aqueous phase was formed and a lower solids-like phase. The lower solids-like phase also was composed of two layers, a tan upper layer and a dark brown lower layer. This example differed from the above examples in that the upper tan layer was found to contain 8.2 wt.% organic material and the lower dark brown layer was found to contain 45.5 wt.% organic material.

Thus, only the nonionic surfactant was able to both remove mineral matter from the oil-shale *and* effect substantial separation of the organic and mineral matter of the beneficiated product.

EXAMPLE 5

The procedure of the above example was followed except 0.4 wt.% Igepal CO 730 was used instead of 4 wt.%.

The result was again an upper aqueous phase and a lower two layered solids-like phase. The upper tan layer was found to contain 27.4 wt.% organic material and the lower dark brown layer was found to contain 24.3 wt.% organic material.

This example demonstrates that 0.4 wt.% nonionic surfactant such as Igepal CO 730, based on the weight of the ammonium salt solution, is insufficient to cause a separation of the organic and mineral matter of the beneficiated product. It is, of course, understood that the amount of nonionic surfactant required would be dependent on the particular surfactant employed as well as the particular oil-shale and process conditions.

What is claimed is:

1. A process for removing mineral matter from oil-shale which process comprises contacting the oil-shale with (a) an ammonium salt solution, and (b) a nonionic surfactant at a temperature from about 0° C. to about 300° C. for a time which is sufficient to substantially separate at least about 80 wt.% of the carbonate mineral matter from the oil-shale.

2. The process of claim 1 wherein the temperature is from about 0° C. to about 100° C. and atmospheric pressure is used.

3. The process of claim 1 wherein the ammonium salt solution contains one or more salts selected from the group consisting of ammonium carbonate, ammonium bicarbonate, ammonium acetate, ammonium nitrate, ammonium sulfate, and ammonium phosphates.

4. The process of claim 3 wherein the ammonium salt solution contains one or both of ammonium nitrate and ammonium sulfate.

5. The process of claim 4 wherein the nonionic surfactant is an ethoxylated derivative of a compound selected from the group consisting of phenols, amines, carboxylic acids, alcohols, mercaptans, and polyhydroxides.

6. The process of claim 5 wherein the surfactant is an ethoxylated phenol having the formula:

$$(R)_r A\text{-}[O(CH_2CH_2O)_p]_q H$$
wherein R is a $C_1$ to $C_{24}$ alkyl group, A is benzene, naphthalene or diphenyl, p is 2 to 60, q is 1 or 2, and r is 1 to 5 with the proviso that when r is 1, R is at least a $C_8$ alkyl group.
7. The process of claim 6 wherein the surfactant is an ethoxylated amine represented by the formula:
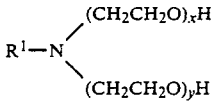
wherein $R^1$ is a $C_8$ to $C_{30}$ aliphatic radical and the sum of x+y is from 2 to 30.
* * * * *